United States Patent [19]

Wilson et al.

[11] 4,373,417

[45] Feb. 15, 1983

[54] ELECTRIC GUITAR

[75] Inventors: Gregg Wilson, Aurora, Colo.; John F. Page, La Mirada, Calif.

[73] Assignee: CBS Inc., New York, N.Y.

[21] Appl. No.: 272,198

[22] Filed: Jun. 10, 1981

[51] Int. Cl.[3] ..... G10H 3/00; G10D 1/08; G10D 3/04; G10D 3/18

[52] U.S. Cl. ..... 84/1.16; 84/267; 84/298; 84/307; 84/328

[58] Field of Search ..... 84/267, 291, 292, 298, 84/299, 307, 308, 328, 177, 116

[56] References Cited

U.S. PATENT DOCUMENTS

| | | | |
|---|---|---|---|
| 2,972,923 | 2/1961 | Fender | 84/307 |
| 2,976,755 | 3/1961 | Fender | 84/1.16 |
| 3,290,980 | 12/1966 | Fender | 84/307 |
| 3,427,916 | 2/1969 | Fender | 84/267 |

OTHER PUBLICATIONS

Fender Brochure, Jan., 1982.

*Primary Examiner*—L. T. Hix
*Assistant Examiner*—Thomas H. Tarcza
*Attorney, Agent, or Firm*—Gausewitz, Carr, Rothenberg & Edwards

[57] ABSTRACT

The economy of manufacture of electric guitars and electric bass guitars is improved, with no loss of quality, by providing an anchor flange in integral relationship with a metal pickguard of the guitar or bass guitar. Extended through the anchor flange are adjustment screws which connect adjustably to bridge barrels over which the strings extend. The adjustment screws and bridge barrels are preassembled to the anchor flange, and all electric components are preassembled to the pickguard, prior to mounting of the pickguard on the body of the guitar or bass. Thus, the ultimate in economy is achieved, yet the anchor flange has very strong support from the pickguard and is located accurately thereby.

10 Claims, 4 Drawing Figures

ELECTRIC GUITAR

BACKGROUND OF THE INVENTION

It has long been common practice for certain manufacturers of electric guitars and electric bass guitars to pre-assemble electric components with the pickguards prior to mounting of the pickguards on the bodies. Furthermore, the use of metal pickguards, as distinguished from plastic pickguards, is in the prior art. However, insofar as applicants are aware, it has never been proposed to further increase economies of manufacture while maintaining great strength of mounting, and accuracy of location, of a bridge component by making it integral with the pickguard.

SUMMARY OF THE INVENTION

The pickguard of an electric guitar or electric bass guitar is formed of sheet metal, and has bent upwardly therefrom, at a region remote from the head of the guitar, a flange which serves to anchor the adjustment screws. The adjustment screws extend from the flange toward the head of the guitar, and are threaded through barrels over which the respective strings of the guitars rest in bridge relationship. The string ends remote from the head are extended through openings in the anchor flange, the openings being sufficiently small to prevent movement therethrough of ball ends which are disposed adjacent the flange.

DETAILED DESCRIPTION OF THE PREFERRED EMBODIMENT

Figure 1:
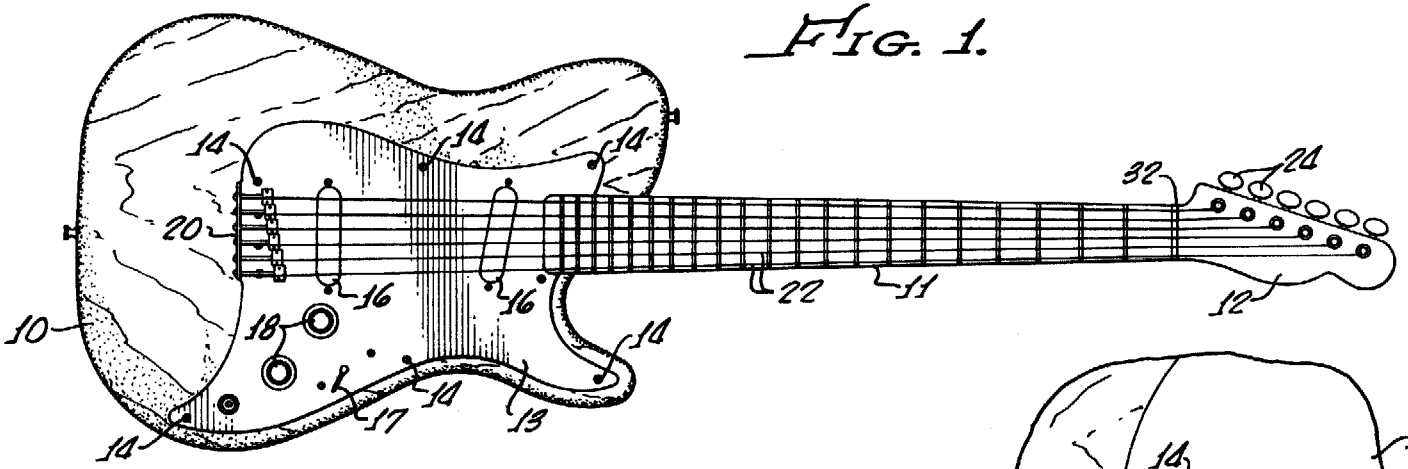
FIG. 1 is a plan view of an electric guitar incorporating the pickguard and bridge construction.

The invention is illustrated as incorporated in an electric guitar of the conventional six-stringed variety, but it is to be understood that the invention is also incorporated in that subspecies of electric guitars called "electric bass guitars", which typically only have four strings adapted to generate bass tones.

The guitar comprises a wooden body 10 from one end of which projects an elongated neck 11 having a head 12 at the outer end thereof.

A pickguard 13, formed by stamping sheet metal, is disposed over large portions of the body 10 and is secured in position by screws 14. Two electromagnetic pickups 16, a control switch 17, and two control knobs 18 (each having an associated variable resistor, not shown) are preassembled to pickguard 13 prior to its mounting onto body 10.

At the edge of pickguard 13 remote from neck 11, in direct alignment with such neck, is an anchor flange 20. Such flange is formed, by stamping, integral with pickguard 13 and bent upwardly at right angles thereto, extending in a direction transverse to the neck. It has a length at least about as long as the width of that portion of neck 11 which is adjacent body 10. Stated otherwise, the ends of flange 20 are preferably in general alignment with the edges of neck 11.

There are twice as many holes formed through flange 20, during stamping thereto, as there are strings. When the guitar is of the illustrated six-stringed variety, there are 12 holes punched through flange 20. Six of the holes, numbered 21, are disposed at a relatively low elevation and equal distances apart for reception, respectively, of the six strings 22 of the illustrated guitar. Ball ends 23 on the ends of strings 22 prevent them from bing drawn through holes 21 when tuning screws 24 on guitar head 12 are turned to tension the strings.

Figure 3:
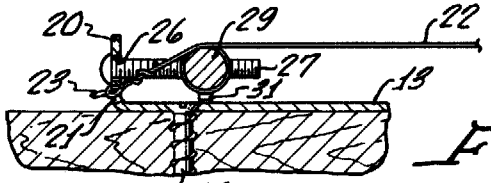
FIG. 3 is a vertical sectional view on line 3—3 of FIG. 2.

The remaining six holes in anchor flange 20 are disposed above, and offset laterally from, holes 21. These remaining holes, one of which is given the number 26 in FIG. 3, are sufficiently large to receive loosely the threaded shanks 27 of adjustment screws 28, which shanks extend parallel to strings 22 toward head 12. The heads of screws 28 are disposed on the side of flange 20 remote from the head 12.

Turning of each screw 28 operates to shift, either toward or away from head 12 of the guitar, a bridge barrel 29 through which the screw is threaded. One of strings 22 extends over each barrel 29, at a groove therein, and then bends downwardly and extends through a hole 21 to the associated ball end. Two posts 31 are externally threaded and extend downwardly through threaded bores in the respective bridge barrels 29, the posts being adapted to be turned in order to determine the elevation of the associated barrel above pickguard 13.

Figure 4:
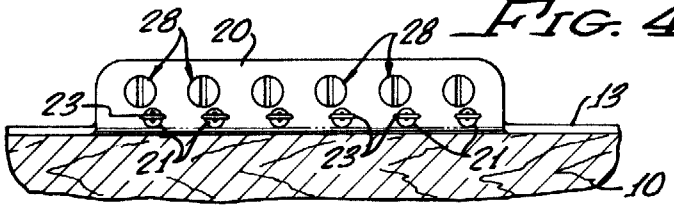
FIG. 4 is an end elevation of the anchor flange, as viewed from the left in FIGS. 2 and 3.

In the illustrated preferred construction and production model, the holes 21 for strings 22 are all disposed in the same plane which is closely adjacent the plane of the upper surface of the body of pickguard 13. The holes 21 being close to the plane of the pickguard, the tensioned strings create almost no torque tending to bend flange 20. In such plane, the holes 21 are spaced equal distances from each other. The holes 26 for the adjustment screws are disposed in a second plane spaced above the plane of holes 21, and holes 26 are likewise spaced equal distances from each other. Holes 26 are so disposed that the axis of each adjustment screw 28 is offset laterally (FIG. 4) only a small distance from the center of the adjacent string hole 21. Thus, the heads of screws 28 are closely adjacent holes 21.

In the assembly of the guitar, the adjustment screws 28, barrels 29, and posts 31 are preassembled with anchor flange 20, just as the pickups 16 and control elements 17 and 18 are preassembled therewith. The amount of labor saved in the guitar-manufacturing operation is substantial. Furthermore, only a small amount of metal is required for flange 20, which flange is readily formed on the body of pickguard 13 by stamping and bending, at least the stamping being performed at the same time that the main body of pickguard 13 is manufactured.

The result is a guitar which is relatively economical to manufacture, yet has fine qualities as well as desired adjustments of string length (the length of the active, vibratory portion of the string, between its bridge barrel and nut 32) and string height.

Figure 2:
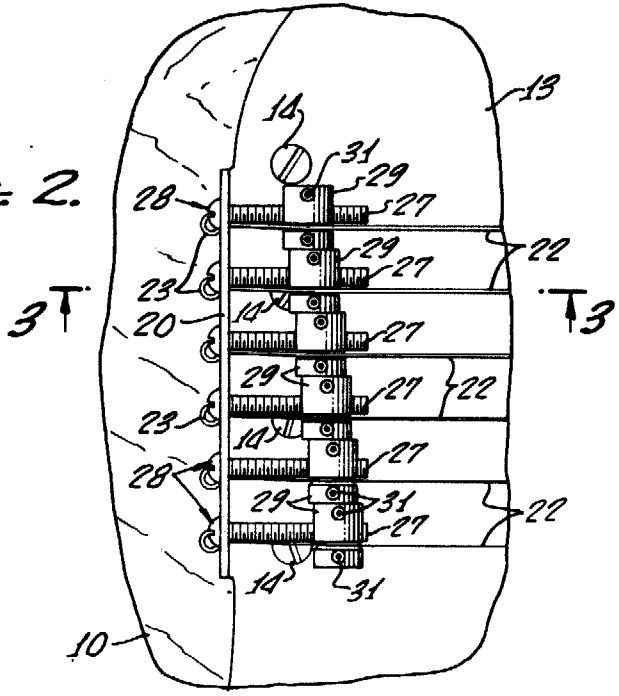
FIG. 2 is an enlarged fragmentary plan view of the region of the pickguard at which the bridge is located.

The anchor flange 20 is strong, even though the gage may be relatively light, for example, 16 gage, since the flange is strongly supported by a plurality of screws 14 disposed adjacent thereto. In the illustrated preferred production embodiment, there are four such screws 14 (FIG. 2) adjacent the flange.

The foregoing detailed description is to be clearly understood as given by way of illustration and example only, the spirit and scope of this invention being limited solely by the appended claims.

What is claimed is:

1. An electric guitar, which comprises:

(a) a wooden body, (b) an elongated neck extending from one end of said body, and having a head at the outer end thereof, (c) a pickguard secured to the upper surface of said body, said pickguard being formed of sheet metal, (d) a flange integral with a region of said pickguard remote from said neck, said region being disposed along an imaginary extension of said neck, said flange extending upwardly from said pickguard, said flange forming part of a bridge assembly, (e) a plurality of tensioned guitar strings extending from said head along said neck and across a portion of said bridge assembly, and (f) pickup means to sense the vibrations of said strings.

2. The invention as claimed in claim 1, in which said flange is formed from the same piece of sheet metal as said pickguard and is bent upwardly from said pickguard.

3. The invention as claimed in claim 1, in which said bridge assembly further comprises an adjustable bridge element for each of said strings, and an adjustment screw extending through said flange and threaded through an associated one of said adjustable bridge elements, whereby said bridge element may be adjusted longitudinally of said strings upon rotation of said adjustment screw, and in which one of said strings extends over each of said adjustable bridge elements and in contact therewith.

4. The invention as claimed in claim 3, in which two adjustable posts are threaded downwardly through each of said adjustable bridge elements into engagement with the upper surface of said pickguard, said posts being adapted to be turned to adjust the elevation of each adjustable bridge element.

5. The invention as claimed in claim 3, in which said strings extend through holes in said flange and connect to ball ends disposed closely adjacent said flange on the side thereof remote from said head.

6. The invention as claimed in claim 3, in which said strings extend through holes in said flange and connect to ball ends disposed closely adjacent said flange on the side thereof remote from said head, and in which each of said adjustment screws extends through a hole in said flange disposed at a higher elevation than that of the hole for the string.

7. The invention as claimed in claim 6, in which said holes for said strings are spaced equal distances apart, said holes for said adjustment screws are spaced equal distances apart, and in which each hole for an adjustment screw is offset relative to the associated hole for said string.

8. The invention as claimed in claim 5, in which the string holes in said flange are disposed closely adjacent the plane of the pickguard.

9. The invention as claimed in claim 1, in which said flange is formed from the same piece of sheet metal as said pickguard and is bent upwardly from said pickguard, and in which said pickguard and flange are formed by stamping.

10. The invention as claimed in claim 1, in which said pickguard is secured to said body by a plurality of screws, in which said flange is formed from the same piece of sheet metal as is said pickguard and is bent upwardly from said pickguard, in which said flange is disposed at the edge of said pickguard remote from said neck, and in which said bridge assembly comprises a barrel for each of said strings, an adjustment screw extended through said flange toward said head and threaded through said barrel, and threaded posts extending downwardly into engagement with the upper surface of said pickguard, said adjustment screws and posts being adapted to be turned in order to adjust the active lengths and elevations of said strings.

* * * * *